US005215405A

United States Patent [19]

Hogan

[11] Patent Number: 5,215,405

[45] Date of Patent: Jun. 1, 1993

[54] APPARATUS FOR LAUNCHING AND RETRIEVING A BOAT

[75] Inventor: James E. Hogan, Byron, Ill.

[73] Assignee: The Hogan Company, Inc., Byron, Ill.

[21] Appl. No.: 699,667

[22] Filed: May 14, 1991

[51] Int. Cl.[5] ..... B63C 3/08

[52] U.S. Cl. ..... 405/2; 405/1

[58] Field of Search ..... 405/2, 1, 3, 4, 7; 114/264; 238/10 R

[56] References Cited

U.S. PATENT DOCUMENTS

| | | | |
|---|---|---|---|
| 3,058,312 | 10/1962 | McDowell | 405/2 |
| 3,285,515 | 11/1966 | Dickinson | 405/1 X |
| 3,587,874 | 6/1971 | Graf | 405/1 X |
| 4,745,873 | 5/1988 | Mott | 405/2 X |
| 4,832,210 | 5/1989 | Wood, II | 405/2 X |

*Primary Examiner*—Dennis L. Taylor
*Assistant Examiner*—J. Russell McBee
*Attorney, Agent, or Firm*—Leydig, Voit & Mayer

[57] ABSTRACT

A track system for launching and retrieving a boat carried on a trailer having two laterally spaced back wheels and having a front wheel which is centered laterally with respect to the back wheels. The system includes two laterally spaced tracks for guiding the back wheels of the trailer and further includes a laterally centered and forwardly projecting track for guiding the front wheel of the trailer. The tracks are adapted to be laid on a bank to establish a smooth and compliant surface enabling the trailer to be backed quickly and easily down the bank and into the water for purposes of launching the boat and also to enable the trailer to be easily pulled up the bank during retrieval of the boat. The tracks are tied together by and are adjustable laterally along longitudinally spaced bars. Also, the tracks are made in sections adapted to be coupled together to form a track system of desired length. Hoses extend along opposite sides of the front wheel track and supply water to spray nozzles in order to wash the bottom of the boat and the trailer during retrieval of the boat.

9 Claims, 1 Drawing Sheet

APPARATUS FOR LAUNCHING AND RETRIEVING A BOAT

BACKGROUND OF THE INVENTION

This invention relates to the launching and retrieval of boats and, more particularly, to a boat which is transported over land on a trailer. A typical boat trailer includes two laterally spaced back wheels and a single front wheel which is centered laterally with respect to the back wheels.

In many cases, fishing boats or the like are launched by backing the trailer down a bank and into the water. The boat then is released from the trailer and is floated into the water. The boat is retrieved by floating the boat onto the trailer, securing the boat in place and then towing the trailer out of the water and up the bank.

This method of launching and retrieval is slow, difficult and sometimes impossible if the bank is rocky, steep or of irregular contour. Such terrain makes it slow and cumbersome to back the trailer down the bank and to subsequently pull the trailer back up the bank. In some cases, the terrain is so unfavorable as to preclude moving the trailer over the terrain.

SUMMARY OF THE INVENTION

The general aim of the present invention is to provide relatively simple and portable apparatus for smoothing out the terrain of a shore bank and enabling a boat trailer to be moved up and down the bank in a quicker and easier manner than has been possible heretofore.

A more detailed object of the invention is to achieve the foregoing through the provision of a portable track system having two laterally spaced tracks for guiding the back wheels of the trailer and having a center track for guiding the front wheel of the trailer. The tracks are laid down the bank and into the water, are tied together and are adjusted laterally in accordance with the spacing and position of the wheels of the trailer. The tracks flex to conform to the contour of the bank and enable the trailer to be backed smoothly and easily down the bank to launch the boat.

Another object of the invention is to provide tracks which are tied together as a unit but which, may be quickly adjusted laterally to accommodate the wheels of virtually any standard boat trailer.

Still another object is to provide sectional tracks which may be joined together as necessary to form a track system having sufficient length to conform to a given shore bank.

The invention also resides in the incorporation in the tracks of means for spray washing the trailer and the boat during retrieval of the boat.

These and other objects and advantages of the invention will become more apparent from the following detailed description when taken in conjunction with the accompanying drawings.

DETAILED DESCRIPTION OF THE PREFERRED EMBODIMENT

Figure 1:
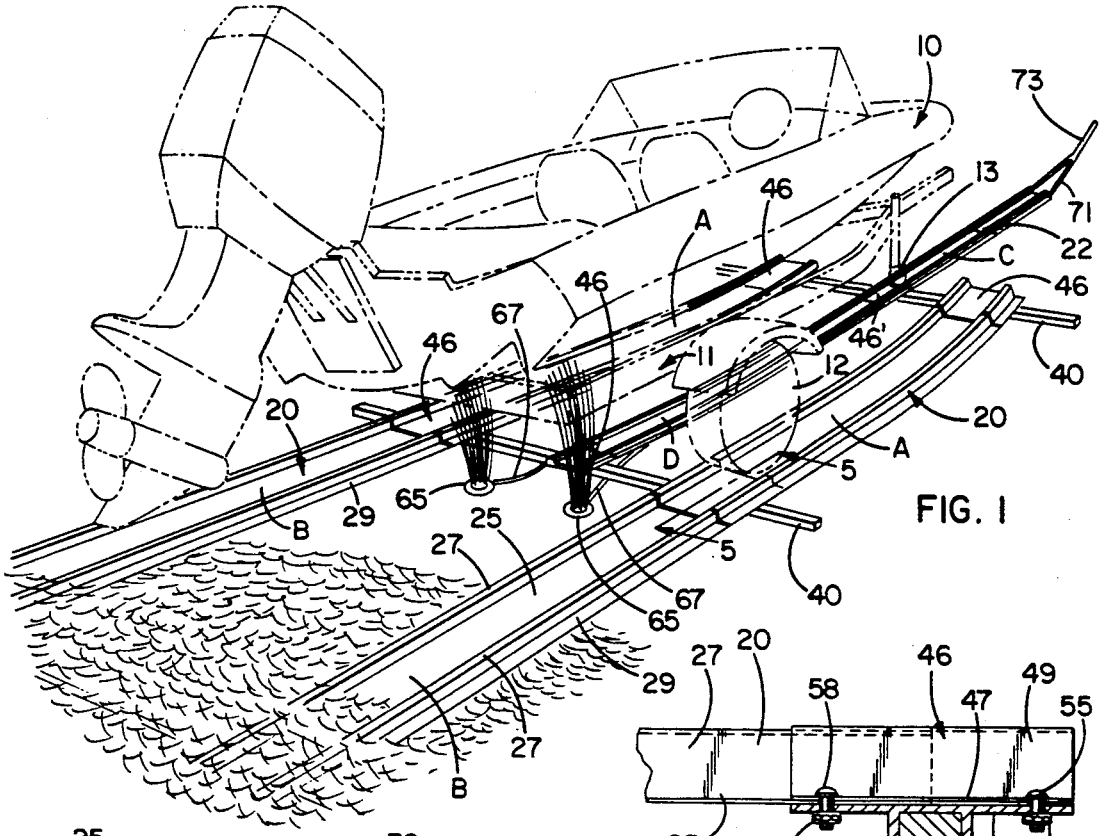
FIG. 1 is a perspective view of a typical boat and trailer in position on a new and improved launching/retrieval track system incorporating the unique features of the present invention.

The present invention has been shown in the drawings as incorporated in a system for launching and retrieving a boat 10, such as a fishing boat or recreational boat, which is transported over land on a trailer 11. Both the boat and the trailer are of conventional design. The trailer includes two laterally spaced back wheels 12, only one of which is visible, and further includes a single front wheel 13 which is centered laterally with respect to the back wheels.

Typically, the boat 10 is launched by backing the trailer 11 down a bank or shore and into the water. Thereafter, the boat is released from the trailer and is floated off of the trailer and into the water. To retrieve the boat, the latter is floated back onto the trailer, is winched toward the front of the trailer, and is secured in place. The trailer then is towed out of the water and up the bank.

The present invention contemplates the provision of a unique track system which smooths out the terrain of the bank or shore and enables the trailer to be quickly and easily backed down the bank and subsequently pulled back up the bank. The track system is particularly characterized in that it is relatively light in weight and is portable, it may be adjusted laterally to accommodate the wheels of virtually any standard boat trailer, and it may be assembled in various lengths as may be required to enable the trailer to travel down the bank and reach the water.

More specifically, the track system includes two laterally spaced back wheel tracks 20 for accommodating and guiding the back wheels 12 of the trailer 11. In addition, the system includes a front wheel track 22 which is centered laterally between the back wheel tracks and which accommodates and guides the front wheel 13 of the trailer.

The two back wheel tracks 20 are identical to one another and each is made from a length of stiff material which still has some flexibility (e.g., fiberglass). Each back wheel track is shaped as an upwardly opening channel and includes a flat and generally horizontal web 25. Formed integrally with and projecting upwardly from opposite side margins of the web are laterally spaced flanges 27 which serve to restrain and guide the back wheels 12 of the trailer 11. Herein, each flange is hollow and is in the shape of an inverted U. A horizontal stiffening strip 29 is formed integrally with and projects laterally from the lower end portion of the outboard side of each flange.

The front wheel track 22 also is made of fiberglass or other stiff but somewhat flexible material and is identical to the back wheel tracks 20 except that the front wheel track 22 has a narrower lateral width in order to restrain and guide the front wheel 13 of the trailer 11. Thus, the front wheel track is in the shape of an upwardly opening U-shaped channel and is defined by a generally horizontal web 35 (FIG. 2), by two laterally spaced flanges 37 formed integrally with and projecting upwardly from the web and by stiffening strips 39 along the outboard sides of the flanges. Each flange 37 of the front wheel track 22 also is hollow and is in the shape of an inverted U.

Figure 2:
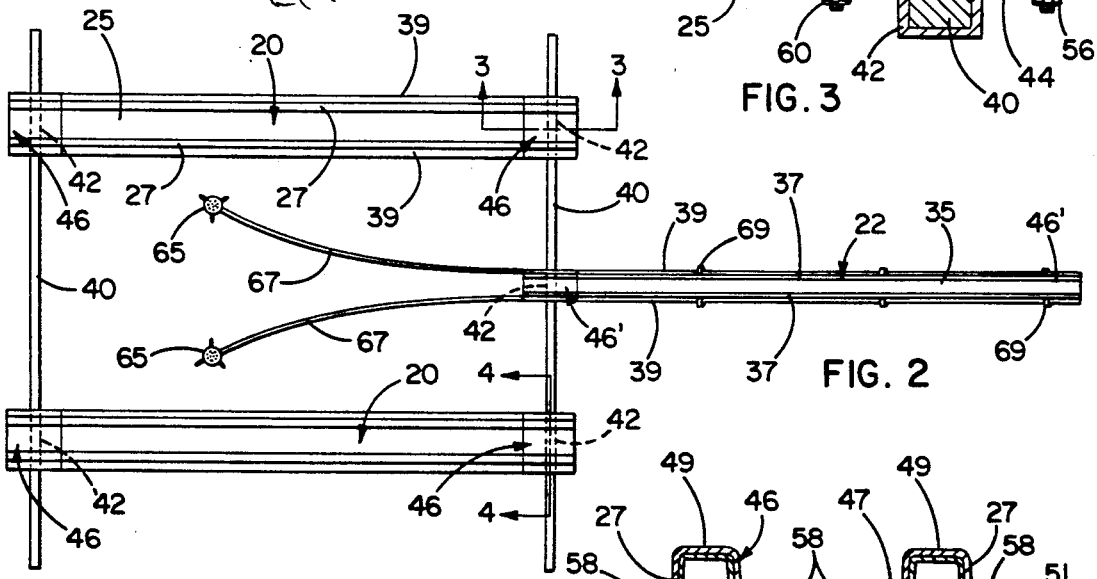
FIG. 2 is a top plan view of a shorter version of the track system.

As shown in FIGS. 1 and 2, the back wheel tracks 20 are spaced laterally from one another while the front wheel track 22 is centered laterally between the back wheel tracks. Preferably, the front wheel track extends forwardly of the back wheel tracks and is located with its forward end spaced a substantial distance forwardly of the forward ends of the back wheel tracks. The rear end of the front wheel track is spaced rearwardly from the front ends of the back wheel tracks but preferably is spaced forwardly from the rear ends of the back wheel tracks.

Means are provided for tying the two back wheel tracks 20 and the front wheel track 22 to one another while permitting the tracks to be adjusted laterally in accordance with the lateral positioning of the wheels 12 and 13 of a particular trailer. Herein, these means comprise a plurality of longitudinally spaced and laterally extending bars 40. The bars may be of various shapes and materials and, in this particular instance, are formed by elongated pieces of fiberglass of rectangular cross-section (e.g., a 2"×4" piece of fiberglass). The bars are adapted to telescope with a snug but slidable fit into rectangular sleeves 42 (FIGS. 3 and 4) secured to the underside of the tracks, each track carrying a plurality of longitudinally spaced sleeves.

To tie the tracks 20 and 22 shown in FIG. 1 to one another, the tracks are positioned such that the sleeves 42 on the front wheel track 22 are aligned longitudinally with sleeves on the back wheel tracks. The bars 40 then are telescoped through the sleeves thus tying the tracks together. By sliding the sleeves 42 of the back wheel tracks 20 along the bars, the back wheel tracks may be spaced laterally from one another in accordance with the lateral spacing of the back wheels 12 of the particular trailer. Similarly, by sliding the sleeves of the front wheel track 22 along the bars, the front wheel track may be centered laterally between the back wheel tracks and located in position to guide the front wheel 13 of the trailer. The snug fit between the bars and the sleeves holds the tracks in their adjusted positions.

Figure 3:
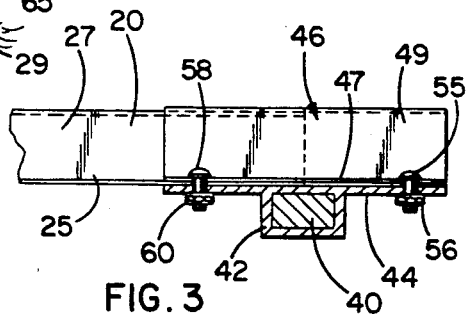
FIGS. 3 and 4 are enlarged fragmentary cross-sections taken substantially along the lines 3—3 and 4—4, respectively, of FIG. 2.
Figure 4:
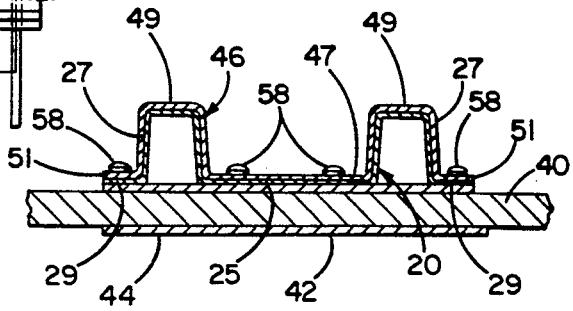

In the present instance, each sleeve 42 also is made of fiberglass and is formed integrally with and depends from a flat and rectangular mounting plate 44 (FIGS. 3 and 4) adapted to be secured to the underside of the respective track 20 or 22. FIGS. 2, 3 and 4 show a sleeve 42 and mounting plate 44 attached to the forward end portion of one of the back wheel tracks 20 of a short track system. For this purpose, a connector 46 is located above the track 20 adjacent the forward end thereof. The connector 46 is in the form of a short length of fiberglass having substantially the same cross-sectional shape as the track 20. Thus, the connector includes a central plate or web 47, upwardly projecting flanges 49 which define downwardly opening channels, and stiffening strips 51 on the outboard sides of the flanges 49. The connector 46 is located on the forward end portion of the track 20 such that its rear end portion overlaps the track while its forward end portion extends forwardly from the track. The web 47 at the rear end portion of the connector 46 lies face-to-face against the upper side of the web 25 of the track 20, the channels defined by the flanges 49 at the rear end portion of the connector receive the flanges 27 of the track 20, and the strips 51 at the rear end portion of the connector lie face-to-face against the strips 29 of the track.

As shown in FIG. 3, the rear end portion of the mounting plate 44 of the sleeve 42 underlies the forward end portion of the track 20 while the forward end portion of the mounting plate projects forwardly of the track and underlies the forward end portion of the connector 46. Laterally spaced fasteners 55 (FIG. 3) in the form of bolts extend through the web 47 and strips 51 of the connector 46 adjacent its forward end portion and also extend through the forward end portion of the mounting plate 44, the bolts being equipped with nuts 56 and thus serving to secure the connector and the mounting plate to one another. Additional laterally spaced fasteners or bolts 58 (FIGS. 3 and 4) extend through the web 47 and strips 51 of the connector 46 adjacent the rear end portion thereof, extend through the web 25 and strips 29 of the forward end portion of the track 20, and extend through the rear end portion of the mounting plate 44, there being nuts 60 (FIG. 3) on the lower end portions of the bolts 58. When the bolts 58 are tightened, the connector 46, the track 20 and the mounting plate 44 with the sleeve 42 are clamped together as a unit thereby to secure the connector and the mounting plate to the track.

Advantageously, the connectors 46 enable lengths or sections of the tracks 20 and the track 22 to be coupled end-to-end with one another to form a track system of any desired length. In the present instance, the back wheel tracks 20 and the front wheel track 22 are formed in sections each having a length of ten feet. FIG. 2 shows the shortest track system which may be assembled by using such sections. As shown, the front wheel track 22 projects approximately ten feet in front of the back wheel tracks 20 and its rear end is equipped with a connector 46'. The connector 46' is identical to the connector 46 except the connector 46' has a narrower lateral width. Secured to the connector 46' is a mounting plate with a sleeve 42 (FIG. 2) for receiving the front bar 40, such bar also being received within sleeves 42 located beneath connectors 46 at the front end portions of the back wheel tracks 20. A rear bar 40 extends through sleeves 42 located beneath connectors 46 at the rear end portions of the tracks 20.

Figure 5:
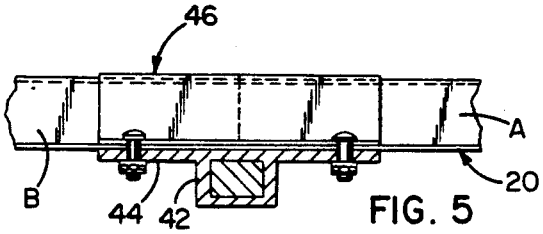
FIG. 5 is an enlarged fragmentary cross-section taken substantially along the line 5—5 of FIG. 1.

FIG. 1 shows a twenty foot system in which each of the back wheel tracks 20 is formed by a front track section designated A and by a rear track section designated B. The front wheel track 22 is formed by a front track section designated C and by a rear track section designated D. The rear track sections B and D are detachably coupled to the front track sections A and C by connectors 46 and 46', each connector being bolted to the adjacent end portions of the tracks in the manner shown in FIG. 5.

With the foregoing arrangement, a track system of any desired or necessary length may be set up by coupling the various track sections together by connectors 46 and 46'. The tracks 20 and 22 flex to accommodate the contour of the terrain and make it relatively easy to back the trailer 11 down steep and rocky banks or down sandy beaches. When the trailer is retrieved, it may be parked on the tracks to enable the boat 10 to be stored out of the water. The tracks 20 and 22, the connectors 46 and 46', the bars 40 and the mounting plates 44 may be easily disassembled and transported in a van, a pick-up truck or similar vehicle.

In accordance with another aspect of the invention, means are associated with the track system and enable the bottom of the boat 10 and the trailer 11 to be washed as the trailer is pulled upwardly out of the water.

Herein, these means comprise two laterally spaced and upwardly directed spray nozzles 65 located between the back wheel tracks 20. The spray nozzles are connected to garden hoses 67 which are strung along opposite sides of the front wheel track 22. The hoses lie along the side strips 39 of the track 22 and may be secured to the track by clips or clamps 69. At their forward ends, the hoses 67 are connected to a Y-fitting 71 (FIG. 1) which also serves as a connector for a single hose 73 leading to a faucet or hydrant. Water delivered through the hoses 73 and 67 sprays upwardly through the nozzles 65 and washes the bottom of the boat and the trailer as the trailer is pulled up the bank and past the heads. Individual shut-off valves for the hoses 67 may be incorporated in the Y-fitting.

I claim:

1. Apparatus for launching and retrieving a boat carried on a trailer having two laterally spaced rear wheels and having a front wheel centered laterally with respect to the rear wheels, said apparatus comprising two laterally spaced and longitudinally extending rear wheel tracks having rear ends, a longitudinally extending front wheel track located between said rear wheel tracks and having a rear end spaced forwardly of the rear ends of said rear wheel tracks, longitudinally spaced bars extending laterally of said tracks, said tracks being connected to and tied together by said bars and being laterally adjustably along said bars to enable a selected lateral spacing to be established between said rear wheel tracks and to enable said front wheel track to be substantially centered laterally between said rear wheel tracks, each of said tracks being shaped as an upwardly opening channel and each having a generally horizontal web and having laterally spaced side flanges projecting upwardly from said web for guiding the respective wheel, each of said tracks comprising a plurality of longitudinally spaced sections, and releasable coupling means for releasably connecting adjacent ends of adjacent sections to one another.

2. Apparatus as defined in claim 1 further including sleeves on the end portions of said tracks and located beneath said tracks, said sleeves telescopically receiving said bars with a snug but slidable fit so as to tie said tracks together while enabling said tracks to be adjusted laterally along said bars.

3. Apparatus as defined in claim 2 further including mounting plates formed integrally with said sleeves, said sleeves projecting downwardly from said plates, and releasable fasteners detachably connecting said plates to the lower sides of the webs of said tracks.

4. Apparatus as defined in claim 1 in which the coupling means between adjacent ends of adjacent track sections comprise a connector having a plate lying against the upper sides of the webs of said adjacent sections, said connector having downwardly opening channels projecting upwardly from said plate and receiving the flanges of said track sections, and means releasably securing said connector to each of said track sections.

5. Apparatus as defined in claim 1 further including hoses extending along and secured releasably to opposite sides of said front wheel track, and upwardly directed spray nozzles connected to said hoses and located between said rear wheel tracks.

6. Apparatus for launching and retrieving a boat carried on a trailer having two laterally spaced back wheels and having a front wheel centered laterally with respect to said back wheels, said apparatus comprising two laterally spaced and longitudinally extending back wheel tracks each having forward and rear end portions and each having upper and lower sides, a longitudinally extending front wheel track located between said back wheel tracks and having forward and rear end portions and upper and lower sides, the forward end portion of said front wheel track being spaced forwardly of the forward end portions of said back wheel tracks, the rear end portion of said front wheel track being spaced rearwardly of the forward end portions of said back wheel tracks and being spaced forwardly of the rear end portions of said back wheel tracks, a plurality of longitudinally spaced and laterally extending sleeves fixed to the lower side of each track, the sleeves on said front wheel track being aligned longitudinally with sleeves on said back wheel tracks, longitudinally spaced and laterally extending bars received snugly but slidably within the sleeves of said front wheel track and within the aligned sleeves of said rear wheel tracks, said bars and sleeves coacting to tie said tracks together while enabling said tracks to be adjusted laterally along said bars to establish a selected lateral spacing between said back wheel tracks and to permit said front wheel track to be substantially centered laterally between said back wheel tracks, each of said tracks being shaped as an upwardly opening channel and each having a generally horizontal web, and laterally spaced side flanges projecting upwardly from each web for guiding the respective wheel.

7. Apparatus as defined in claim 6 in which the lateral width of said front wheel track is substantially less than the lateral width of said rear wheel tracks.

8. Apparatus as defined in claim 6 further including a mounting plate integral with each sleeve, each sleeve projecting downwardly from its associated mounting plate.

9. Apparatus as defined in claim 6 further including hoses extending along and secured releasably to opposite sides of said front wheel track, and upwardly directed spray nozzles connected to said hoses and located between said back wheel tracks.

* * * * *